United States Patent [19]

Babendererde

[11] Patent Number: 4,911,578

[45] Date of Patent: Mar. 27, 1990

[54] PROCESS FOR MAKING A TUNNEL AND ADVANCING A TUNNELING READ WITH A WALL-SUPPORTING SHIELD

[75] Inventor: Siegmund Babendererde, Lübeck-Travemünde, Fed. Rep. of Germany

[73] Assignee: Hochtief Aktiengesellschaft Vorm. Gebr. Helfmann, Essen, Fed. Rep. of Germany

[21] Appl. No.: 232,606

[22] Filed: Aug. 15, 1988

[30] Foreign Application Priority Data

Aug. 13, 1987 [DE] Fed. Rep. of Germany ..... 3726900

[51] Int. Cl.[4] ..... E21D 9/06; E21D 11/10

[52] U.S. Cl. ..... 405/146; 405/147

[58] Field of Search ..... 405/146, 147, 150, 266, 405/141

[56] References Cited

U.S. PATENT DOCUMENTS

| | | | |
|---|---|---|---|
| 3,672,173 | 6/1972 | Paramore et al. | 405/266 |
| 3,774,683 | 11/1973 | Smith et al. | 405/266 X |
| 3,845,632 | 11/1974 | Slobod et al. | 405/266 |
| 4,437,788 | 3/1984 | Walbrohl | 405/146 |
| 4,645,378 | 2/1987 | Hentschel | 405/146 |
| 4,695,188 | 9/1987 | Pulkkinen | 405/150 |
| 4,789,267 | 12/1988 | Babendererde et al. | 405/146 |

*Primary Examiner*—David H. Corbin

*Attorney, Agent, or Firm*—Herbert Dubno

[57] ABSTRACT

In my process for digging a tunnel with the help of a tunnel excavator which has a working chamber under atmospheric pressure, the local front wall is supported with the help of a pressurized medium which is connected by a controlling gap of a shield cover with another gap between a shield cover tail and/or the earth or ground and a tunnel-lining member. The gap is closed-off from the working chamber by a gap-sealing ring between a shield cover tail and a tunnel-lining member. Concrete is forced into the gap by a feeder pipe in the gap-sealing ring. A self-sealing permeable joint between the gap-sealing ring and the shield cover tail and/or the tunnel-lining member of the excavator is made with concrete which has a fine-grained additive material and a large-grained additive material so that the large-grained additive material forms a grain filter whose pores are closable by the fine-grained additive material.

3 Claims, 3 Drawing Sheets

PROCESS FOR MAKING A TUNNEL AND ADVANCING A TUNNELING READ WITH A WALL-SUPPORTING SHIELD

CROSS-REFERENCE TO RELATED APPLICATIONS

This application is related to the following copending applications: Ser. Nos. 06/882,274 filed 7 July 1986; 07/017,189 filed 19 Feb. 1987; 07/61,864 filed 11 June 1987; 07/129,655 filed 7 Dec. 1987; 07/157,848 filed 18 Feb. 1988; and Ser. No. 07/175,191 filed 30 Mar. 1988. Reference may also be had to the following commonly owned patents: Pat. Nos. 4,140,345 issued 20 Feb. 1979; 4,621,947 issued 11 Nov. 1986; 4,629,25 issued 16 Dec. 1986; and 4,687,374 issued 18 Aug. 1987.

FIELD OF THE INVENTION

My present invention relates to a process for making a tunnel with a tunnel excavator, especially a tunnel with a concrete-lined tunnel wall. The invention also relates to a process for advancing the excavator and progressively formed concrete wall.

BACKGROUND OF THE INVENTION

A tunnel-making process can use a tunnel excavator which has a working chamber operating under atmospheric pressure in which the local front wall is supported with the help of a pressurized medium.

The working chamber is connected by a controlling gap of a shield cover with the gap between the shield cover tail of the excavator and/or the earth or ground and the tunnel-lining member. The gap between the shield cover tail and the tunnel-lining member is closed off from the working chamber by a gap-sealing ring and concrete is forced into the gap through a feeder pipe in the gap-sealing ring.

Thus it is possible to operate in loose ground. The pressurized medium is a fluid medium. It can be pressurized with water, a thixotropic fluid or with a gas, especially air. The concrete can have any binder, especially a hydraulic binder or a plastic resin binder. The gap-sealing ring can be constructed in different ways.

Permeable gaps between the gap-sealing ring and the shield cover tail and/or the tunnel-lining member cannot always be prevented. That is particularly true when the tunnel-lining member is constructed as a tubing assembled from a plurality of tubing segments and a slight displacement of the individual tubing segments relative to each other in a radial direction cannot be prevented. In particular, this problem has serious consequences as described below.

In tunnel excavation, especially in loose ground, the local front wall is supported either mechanically by a excavating disk or by a pressurized medium. The mechanical support is incomplete and causes deformation of the local front wall which triggers sinking or settling of the upper surface of the ground. Support of the local front wall by a fluid is very effective and leads to tunnel excavation characterized by very little settling of the ground.

It is disadvantageous, however, that the broken earth must be removed mixed with the fluid. It is separated from the fluid below ground which is particularly expensive with fine-grained earth.

Supporting the local front wall with pressurized air is particularly advantageous by contrast, because the excavated earth can be transported away dry.

In current practice, the entire tunnel pipe can be put in place under pressurized air to support the ground at the local front wall. Attempts to put only the working chamber in the front portion of the shield cover under pressurized air to allow the digging team or crew to operate under atmospheric pressure indeed have been known to fail.

Pressurized medium losses and particularly pressurized air losses occur when the pressurized medium flows rearwardly in the controlling gap to the outside of the shield cover and forces its way through the incomplete seal at the gap-sealing ring into the working chamber. This gap which has a thickness of about 10 cm is simultaneously filled with concrete in the described way on forward motion of the shield cover to prevent the surrounding earth which can also be below the water table from entering the gap. It is not guaranteed, however, that the applied concrete pressure is always reliably greater than the pressure which arises because of load. Hence earth can fall into the gap so that it is impossible to fill the gap at the shield cover tail completely. Similarly that condition also is effected when the tunnel is made in ground comprising loose or broken stone.

The pressurized medium, especially a gaseous pressurized medium, which runs through the gap surrounding the shield cover until behind the shield cover tail, flows through an only incompletely filled gap. If the gap-sealing ring is not sealed, the pressurized medium in the working chamber escapes.

An incomplete filling of the gap can be countered with a moving elastically supported gap-sealing ring (see, for example, German Patent document 36 42 893.0-24).

However, a reliable filling of the gap cannot be attained in this way, when a tubing with tubing segments is used for a tunnel-lining member and an offset between adjacent tubing segments can develop over which the seal of the gap-sealing ring passes producing leakage gaps with widths up to 15 mm.

The fluid concrete forced-in flows through this permeable seal into the shield cover interior unless the provided pressure can be maintained in the concrete for support of the of about 10 cm is simultaneously filled with concrete in the described way on forward motion of the shield cover to prevent the surrounding earth which can also be below the water table from entering the gap. It is not guaranteed, however, that the applied concrete pressure is always reliably greater than the pressure which arises because of load. Hence earth can fall into the gap so hat it is impossible to fill the gap at the shield cover tail completely. Similarly that condition also is effected when the tunnel is made in ground comprising loose or broken stone.

The pressurized medium, especially a gaseous pressurized medium, which runs through the gap surrounding the shield cover until behind the shield cover tail, flows through an only incompletely filled gap. If the gap-sealing ring is not sealed, the pressurized medium i the working chamber escapes.

An incomplete filling of the gap can be countered with a moving elastically supported gap-sealing ring (see, for example, German Patent document 36 42 893.0-24).

However, a reliable filling of the gap cannot be attained in this way, when a tubing with tubing segments is used for a tunnel-lining member and an offset between adjacent tubing segments can develop over which the seal of the gap-sealing ring passes producing leakage gaps with widths up to 15 mm.

The fluid concrete forced-in flows through this permeable seal into the shield cover interior unless the provided pressure can be maintained in the concrete for support of the surrounding earth. The danger of the concrete flowing away in this manner is, however, greater when the concrete pressure is higher which is required when the tunnel being dug is deep.

OBJECTS OF THE INVENTION

It is an object of my invention to provide an improved process for making a tunnel with a tunnel digging machine or excavator in which a self-sealing permeable joint or gap between the gap-sealing ring and the shield cover tail of the excavator and/or the tunnel-lining member seals itself so that the above-described disadvantages are avoided.

It is also an object of my invention to provide an improved process for making a tunnel with a tunnel digging machine or excavator in which a self-sealing permeable joint or gap between the gap-sealing ring and the shield cover tail of the excavator and/or the tunnel-lining member is provided, especially when the tunnel-lining member comprises a plurality of tunnel-lining segments displaceable laterally from each other so that fluidized concrete forced i is not lost.

SUMMARY OF THE INVENTION

According to my invention, a self-sealing mobile joint between the gap-sealing ring and the shield cover tail of the excavator and/or the tunnel-lining member is made with the concrete which has a fine-grained additive material and a coarse-grained additive material or aggregate.

The coarse-grained additive material for the self-sealing permeable joint forms a grain filter whose pores are closable by the fine-rained additive material. The concrete forced-in is usually made according to the prevailing instructions and usually has other additive substances including a flow promoting agent, a retardant and a stabilizer. The grain filter forms a self-sealing permeable joint because of hydrodynamic considerations and eventually it forms a stopper and complete seal.

Advantageously, the grain size of the coarse-grained additive material is not less than 4 mm. With such a grain size the described grain filter action is always attained. That is particularly true when concrete which has a fine-grained additive material including sand and/or fibers is used.

A particularly advantageous embodiment of my invention mixes amorphous silicic acid in the form of precipitated silicic acid or silicic acid made by high temperature hydrolysis with the concrete.

Of particular significance are embodiments in which a gap-sealing ring, which is supported elastically in the described way and whose elastic support presses against the concrete forced into the gap, is used. The combination of the process steps described with the use of this type of gap-sealing ring is of particular significance. The seal obtained with the grain filter is surprisingly effective when the concrete is forced in under a pressure of up to 10 bar in the gap.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 3:
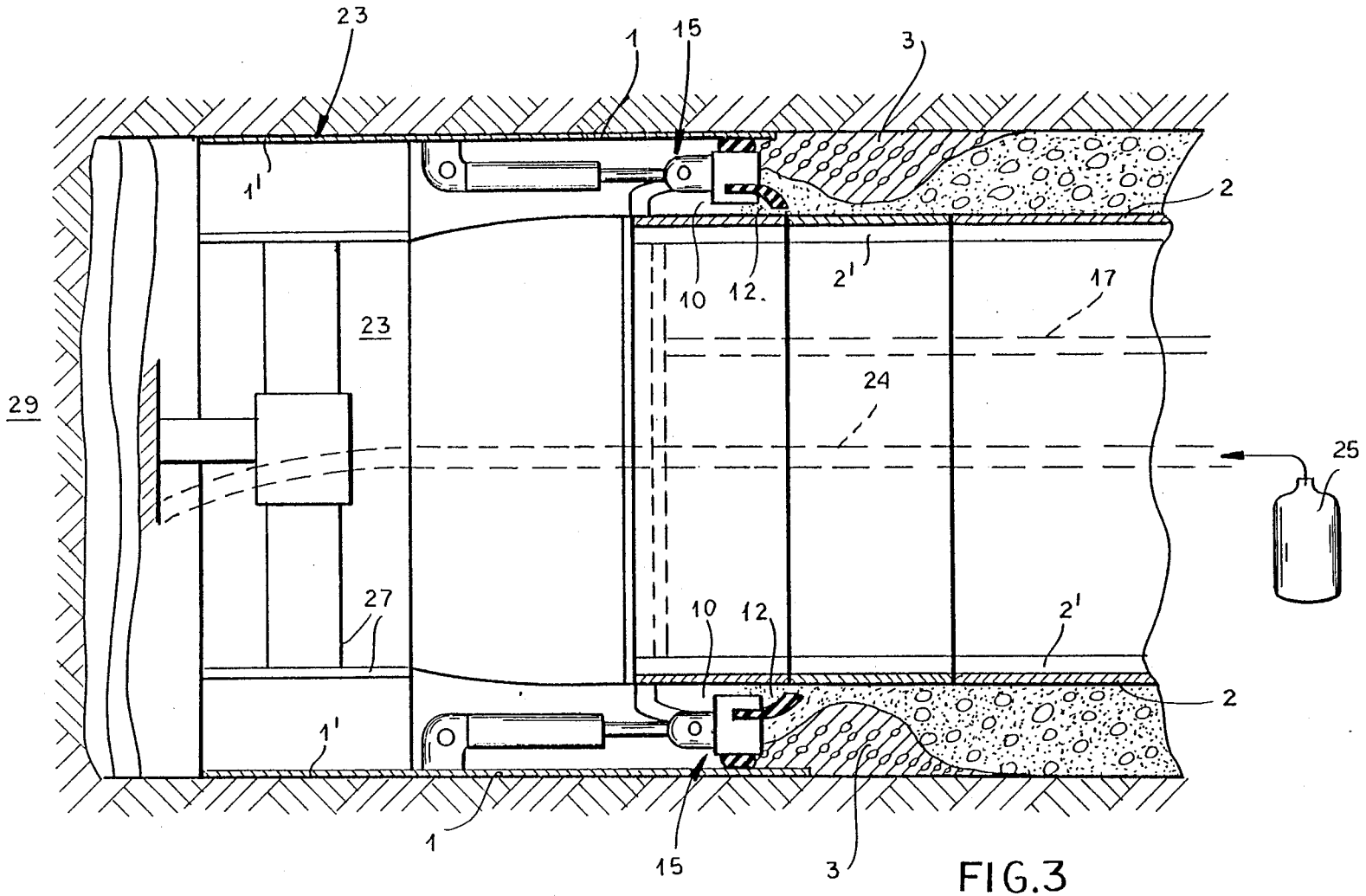
FIG. 3 is a cross-sectional view of a tunnel excavator with a gap-sealing ring in place supported resiliently on the shield cover of the excavator.

The gap-sealing ring 15 shown in the drawing is located between the rear end portion of a shield cover tail 1 of the tunnel digging machine and the front end portion of a tunnel-lining member 2 and it seals the gap 3 in one step by forcing in concrete through the line 17 shown in dotted in FIG. 3. The gap-sealing ring 15 is supported so as to be freely movable relative to the shield cover tail 1 and the tubing 2 by an adjustable supporting unit comprising a piston-cylinder drive 19 resiliently in the tunnel digging direction. For example, it can be connected to the shield cover 1'. In the drawing these supporting units are mounted by one of several attaching eyes 4.

Figure 2:
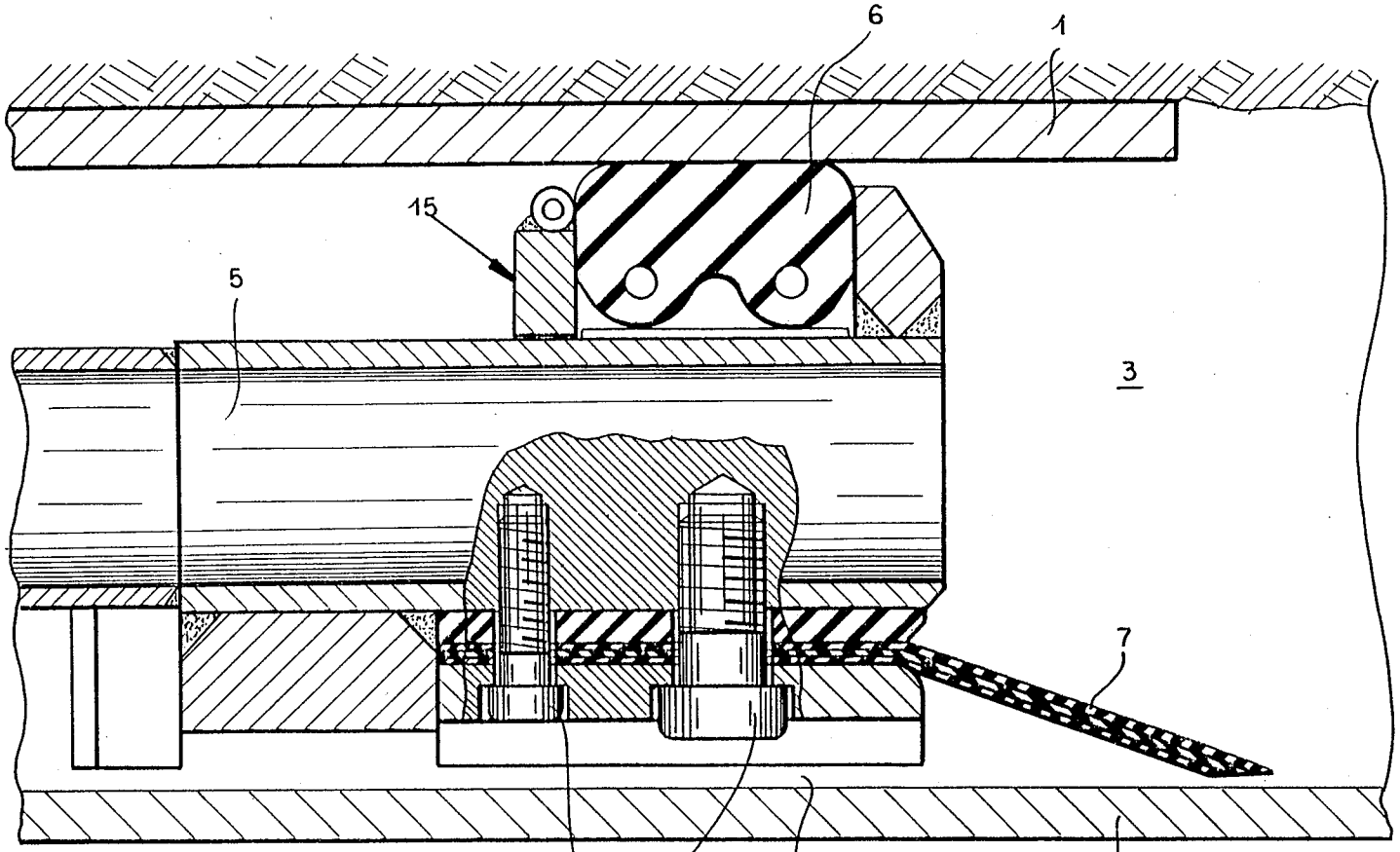
FIG. 2 is a cross-sectional view through the gap-sealing ring of FIG. 1 taken in another angular position by rotation of the plane of FIG. 1 about the axis of the tunnel.

A plurality of extruded material feeder pipes 5 are provided distributed uniformly about the circumference of the tunnel on the front end of the gap-sealing ring 15 (see FIG. 2). Moreover, the gap-sealing ring 15 has an elastic outer seal 6 and an elastic inner seal 7. The elastic outer seal 6 comprises a rubber or plastic ring, which is placed on the inner side of the shield cover tail 1. Suitable radial screws 8 are also provided for securing the seals. The inner seal 7' pressible against the outside of the tubing 2 comprises a trailing spring plate 7 which is attached by radial screws 9 to the gap-sealing ring 15

Figure 1:
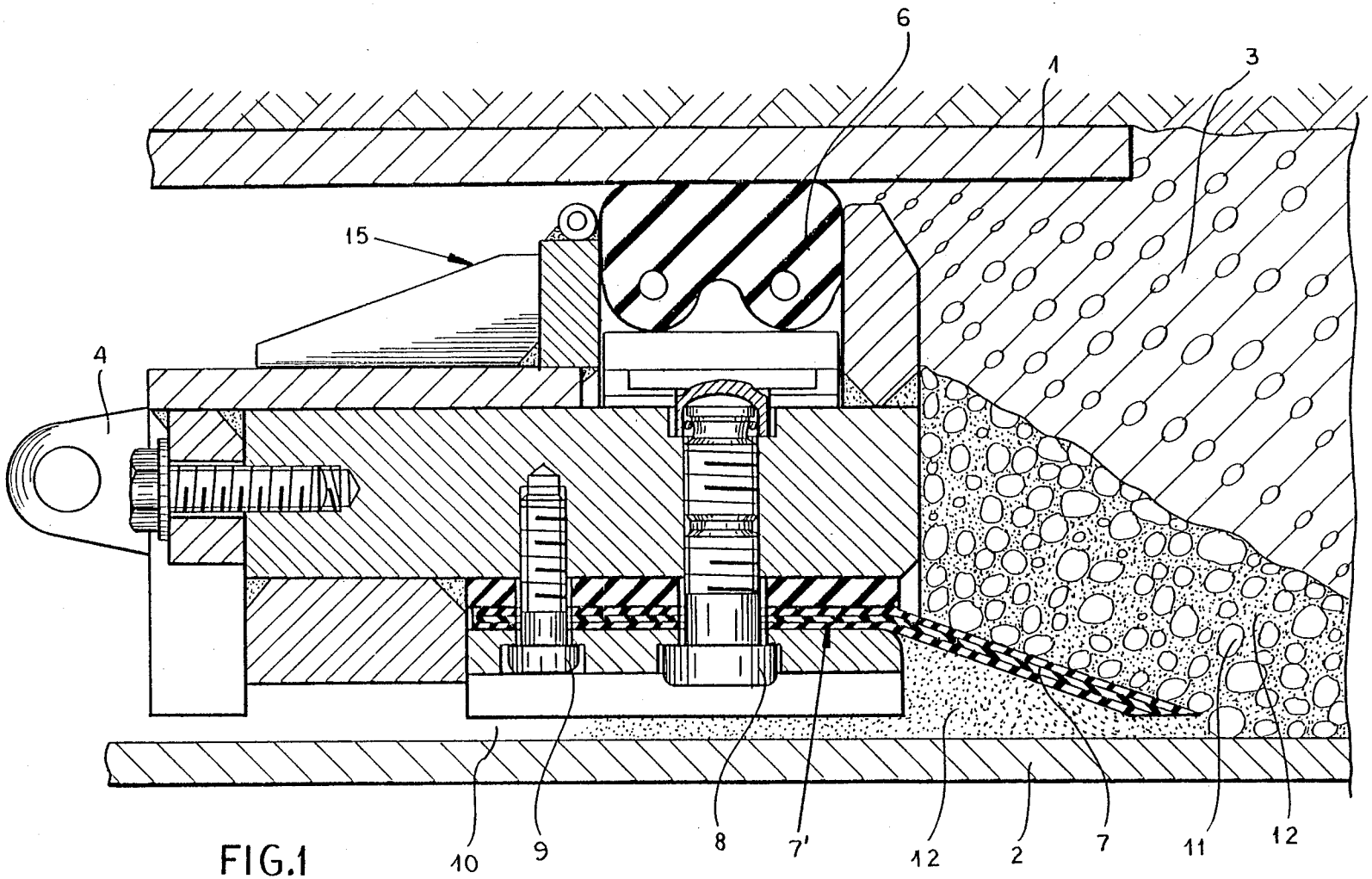
FIG. 1 is a cross-sectional view through a gap-sealing ring of a tunnel excavator using the process according to my invention.

A self-sealing permeable joint 10 was formed as is indicated in FIGS. 1 and 2 by backfilling on segments of the tubing 2 in the vicinity of the part of the tunnel where the section was taken. FIG. 1 shows that a grain filter 11 for the self-sealing permeable joint 10 has been constructed from coarse or large-grained additive material 11 for the concrete and the pores of the grain filter can be closed by a fine-grained additive material 12 which has also been provided.

Some of the fine-grained additive passes through the grain filter and also close the self-sealing permeable joint 10.

The portion of the fine-grained additive material 12, especially of the powdery grain-size content, can be increased relative to that in the standard extruded concrete. A particularly advantageous embodiment of my invention is characterized by mixing amorphous silicic acid in the form of precipitated silicic acid or silicic acid made by high temperature hydrolysis with concrete.

Usually 2 to 4 percent-by-weight of amorphous silicic acid relative to the cement weight is sufficient. The seal can be improved by formulation with standard additive materials, such as a fluidizing agent, a retardant and a stabilizer. In my process one can also mix bentonite with the concrete, for example in an amount of from 2 to 6 percent-by-weight advantageously about 4 percent-by-weight relative to the cement weight.

The tubing 2 is one example of a tunnel-lining member which forms the inner wall of the tunnel. It can be assembled from a series of tubing segments 2' as has been shown in FIG. 3.

By the "front of the tunnel-lining member" in the drawing, I mean the left-hand side of FIG. 1 or FIG. 2 or the side which is closest to the unshown tunnel digging machine or excavator 21.

As shown in FIG. 3, in my invention, a tunnel excavator 21 has a working chamber 23 operating under atmospheric pressure in which the local front wall 29 is supported with the help of a pressurized medium. In this case the pressurized medium is pressurized air which is supplied by a line 24 and an air supply tank 25. The working chamber 23 is connected by a controlling gap 27 of the shield cover 1 with the other gap 3 between the shield cover tail and/or the earth or ground and the tunnel-lining member 2.

I claim:

1. A method of forming a tunnel, comprising the steps of:

(a) advancing a tunnel excavator through a subterranean structure to form a tunnel-shaped excavation therein having a chamber under atmospheric pressure and an exposed excavated wall;

(b) disposing a tunnel lining in said excavation with all-around spacing from said wall, said tunnel excavator having a tail shield trailing said excavator, lying along said wall and spaced from and surrounding said lining;

(c) pumping concrete into an annular space defined between said lining and said wall at an elevated pressure;

(d) confining said space in a direction of advance of said excavator by providing a gap-sealing ring between said tail shield and said tunnel lining;

(e) supporting said ring with fluid pressure to resist advance of the ring in said direction;

(f) forcing said ring in said direction with the pressure of the concrete pumped into said space;

(g) providing a gap between said ring and at least one of said tail shield and said lining; and (h) sealing said gap by:

($h_1$) incorporating in said concrete a coarse-grained aggregate of a particle size of at least 4 mm and such that said coarse-grained aggregate forms a layer upstream of said gap in a flow direction through said gap, ($h_2$) incorporating the concrete pumped into said space a fine-grained aggregate of a particle size comprising sand or fibers and such that said fine-grained aggregate is trapped in said layer, and ($h_3$) forcing the concrete through said gap so that said layer is formed, traps said fine-grained aggregate and the trapped five-grained aggregate in said layer seals said gap.

2. The method defined in claim 1 wherein the proportion of said fine grained aggregate is greater than a standard proportion of a fine grained aggregate in conventional concrete.

3. The method defined in claim 1 wherein silicic acid in the form of precipitated silicic acid or high temperature hydraulic silicic acid is mixed with the concrete.

* * * * *